US008292121B2

(12) United States Patent
Davideit et al.

(10) Patent No.: US 8,292,121 B2
(45) Date of Patent: Oct. 23, 2012

(54) FITMENT AND VALVE APPARATUS FOR BAG-ON-VALVE DEVICE

(75) Inventors: Daniel E. Davideit, Manchester, NH (US); Kevin Verville, Deerfield, NH (US)

(73) Assignee: Summit Packaging Systems, Inc., Manchester, NH (US)

( * ) Notice: Subject to any disclaimer, the term of this patent is extended or adjusted under 35 U.S.C. 154(b) by 407 days.

(21) Appl. No.: 12/667,423

(22) PCT Filed: Jul. 16, 2008

(86) PCT No.: PCT/US2008/070173

§ 371 (c)(1), (2), (4) Date: Dec. 31, 2009

(87) PCT Pub. No.: WO2009/012306

PCT Pub. Date: Jan. 22, 2009

(65) Prior Publication Data

US 2011/0007987 A1 Jan. 13, 2011

Related U.S. Application Data

(60) Provisional application No. 60/949,965, filed on Jul. 16, 2007.

(51) Int. Cl.

| | |
|---|---|
| ***B65D 35/28*** | (2006.01) |
| ***B65D 35/56*** | (2006.01) |
| ***B65D 35/00*** | (2006.01) |
| ***B65D 5/72*** | (2006.01) |
| ***B65D 25/40*** | (2006.01) |
| ***B65D 35/38*** | (2006.01) |
| ***B67D 7/60*** | (2010.01) |
| ***G01F 11/00*** | (2006.01) |

(52) U.S. Cl. ..... 222/95; 222/105; 222/386.5; 222/107; 222/566

(58) Field of Classification Search ..... 222/95, 222/105, 183, 386.5, 389, 402.1, 394, 94, 222/566, 107; 220/495.06; 383/904, 906
See application file for complete search history.

(56) References Cited

U.S. PATENT DOCUMENTS

| | | | | |
|---|---|---|---|---|
| 3,491,918 | A * | 1/1970 | Lucas | 222/635 |
| 3,658,215 | A | 4/1972 | Ewald | |
| 3,674,185 | A | 7/1972 | Evesque | |
| 3,709,410 | A | 1/1973 | Cunningham | |
| 3,845,888 | A | 11/1974 | Focht | |

(Continued)

FOREIGN PATENT DOCUMENTS

| | | |
|---|---|---|
| DE | 19832824 | 7/1998 |

(Continued)

OTHER PUBLICATIONS

European Search Report—Application No. 08826466.8—2425/2167394-PCT/US2008070173—Date Sep. 8, 2010.

*Primary Examiner* — Kevin P Shaver
*Assistant Examiner* — Vishal Pancholi

(57) ABSTRACT

A two-way valve and fitment for engaging a valve with a flexible product dispensing bag and particularly to a valve body formed in conjunction with the fitment to facilitate both the sealing of the bag to the fitment as well as filling the bag with a product to be dispensed therefrom and subsequently dispensing the product from the bag via a pressurized fluid source.

10 Claims, 14 Drawing Sheets

U.S. PATENT DOCUMENTS

| | | | | |
|---|---|---|---|---|
| 3,877,616 | A | 4/1975 | Stevens | |
| 3,893,653 | A | 7/1975 | Kolanus | |
| 4,266,941 | A | 5/1981 | Sullivan | |
| 4,328,911 | A | 5/1982 | Knickerbocker | |
| 4,360,131 | A | 11/1982 | Reyner | |
| 4,376,500 | A | 3/1983 | Banks et al. | |
| 4,471,893 | A | 9/1984 | Knickerbocker | |
| 4,475,667 | A | 10/1984 | Ori et al. | |
| 4,478,044 | A | 10/1984 | Magid | |
| 4,491,250 | A | 1/1985 | Liebermann | |
| 4,510,734 | A | 4/1985 | Banks et al. | |
| 4,621,483 | A | 11/1986 | Magid | |
| 4,813,576 | A | 3/1989 | Greenebaum, II | |
| 4,915,266 | A | 4/1990 | Knickerbocker | |
| 4,958,757 | A | 9/1990 | Greenebaume, II | |
| 5,125,546 | A | 6/1992 | Dunne et al. | |
| 5,137,180 | A | 8/1992 | Kieras | |
| 5,169,037 | A | 12/1992 | Davies et al. | |
| 5,320,255 | A | 6/1994 | Stoffel et al. | |
| RE35,540 | E | 6/1997 | Davies et al. | |
| 5,823,383 | A | 10/1998 | Hins | |
| 5,873,491 | A | 2/1999 | Garcia | |
| 5,906,046 | A | 5/1999 | Abplanalp et al. | |
| 6,092,698 | A | 7/2000 | Bayer | |
| 6,131,806 | A | 10/2000 | Hess, III et al. | |
| 6,170,760 | B1 | 1/2001 | Bievenue et al. | |
| 6,241,132 | B1 | 6/2001 | Morrison | |
| 6,273,307 | B1 * | 8/2001 | Gross et al. | 222/566 |
| 6,318,595 | B1 | 11/2001 | Walters | |
| 6,375,046 | B1 | 4/2002 | Alleard et al. | |
| 6,491,187 | B2 | 12/2002 | Walters | |
| 6,523,757 | B1 | 2/2003 | Bievenue et al. | |
| 6,588,628 | B2 | 7/2003 | Abplanalp et al. | |
| 6,592,010 | B2 | 7/2003 | Plessis | |
| 6,601,735 | B2 | 8/2003 | Milian et al. | |
| 6,698,620 | B2 | 3/2004 | Ogata et al. | |
| 6,799,690 | B2 | 10/2004 | de Pous et al. | |
| 6,974,055 | B2 | 12/2005 | Moore et al. | |
| 7,232,042 | B2 * | 6/2007 | Last | 222/1 |
| 2001/0023877 | A1 | 9/2001 | Walters | |
| 2003/0102328 | A1 | 6/2003 | Abplanalp et al. | |
| 2004/0011824 | A1 | 1/2004 | Walters et al. | |
| 2005/0017026 | A1 | 1/2005 | Yerby et al. | |
| 2005/0061831 | A1 * | 3/2005 | Brown et al. | 222/107 |
| 2005/0224518 | A1 | 10/2005 | Walters et al. | |
| 2006/0048843 | A1 | 3/2006 | Yerby et al. | |
| 2007/0047851 | A1 * | 3/2007 | Sato et al. | 383/104 |
| 2007/0205202 | A1 * | 9/2007 | Hildebrand et al. | 220/613 |
| 2007/0235471 | A1 * | 10/2007 | Radermacher | 222/95 |

FOREIGN PATENT DOCUMENTS

| | | |
|---|---|---|
| EP | 0317865 | 11/1988 |
| EP | 0445358 | 10/1990 |
| EP | 0694484 | 7/1995 |
| FR | 2650342 | 7/1989 |
| GB | 2004585 | 9/1977 |
| GB | 2012885 | 1/1978 |
| WO | WO93/00276 | 6/1991 |
| WO | WO9509054 | 4/1995 |
| WO | WO98/42592 | 3/1997 |
| WO | WO 99/62785 | 9/1999 |
| WO | WO 00/63080 | 10/2000 |

* cited by examiner

FIG. 4A
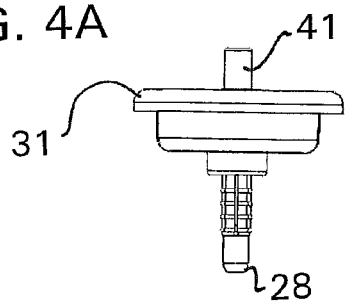
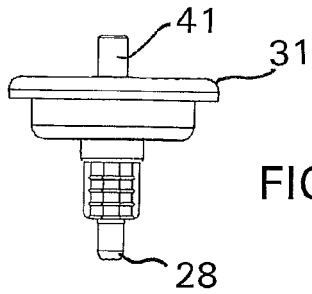
FIG. 4B
FIG. 5
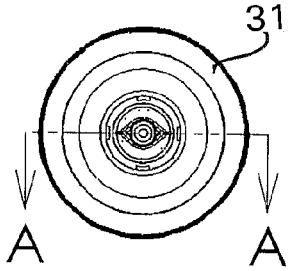
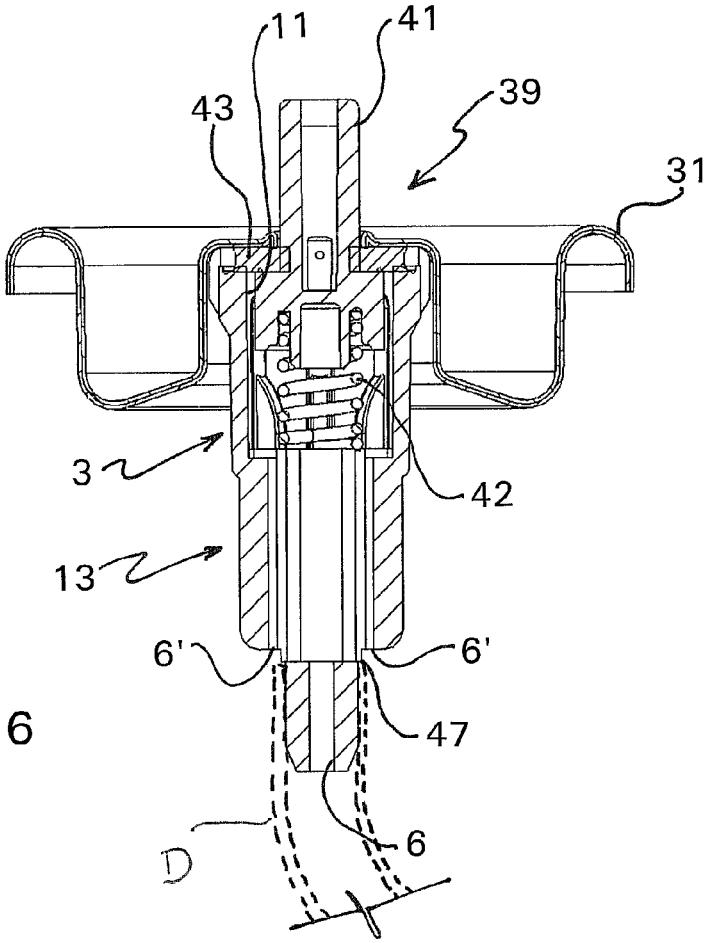
FIG. 6

FITMENT AND VALVE APPARATUS FOR BAG-ON-VALVE DEVICE

This application claims the benefit of U.S. Provisional Application 60/949,965 filed Jul. 16, 2007.

FIELD OF THE INVENTION

The present invention relates to a valve, generally a two-way valve and a fitment for engaging the valve with a flexible product dispensing bag and particularly to a valve body formed in conjunction with the fitment to facilitate both the sealing of the bag to the fitment as well as filling the bag with a product to be dispensed therefrom and subsequently dispensing the product from the bag.

BACKGROUND OF THE INVENTION

Collapsible and highly flexible product bags or pouches have become common in different industries for containing a variety of food, beverage, personal care or household care or other similar products. Such product bags can be used alone to allow a user to manually squeeze and dispense a product from the bag or the product bags may be utilized in combination with a pressurized can and product, for example an aerosol. Such product bags and valves contained in and used with aerosol cans are generally referred to in the aerosol dispensing industry as bag-on-valve technology. These product bags, valves and cans may be designed to receive and dispense a desired product in either a liquid or semi-liquid form which have a consistency so as to be able to be expelled from the valve or outlet when desired by the user.

It is known to utilize a product dispenser, such as a can, which has the collapsible product bag inserted therein, usually in a rolled up manner, and from which a filling/dispensing valve communicating with the inside of the product bag is affixed in a mounting cup portion of the valve and the mounting cup is attached to the can. During a final manufacturing phase, a product bag, having the valve secured thereto by a fitment, is generally in a rolled up configuration and the valve body is connected to a mounting cup. The rolled up product bag is inserted into or through the top of a product dispensing can and the mounting cup is secured to a rim of the can or container.

In a filling process, a desired product is inserted into the product bag via the two-way valve by appropriate filling means. When the bag is filled by the filling mechanism, the product bag expands inside the can. At some point in the manufacturing process, the can is further provided with a pressurized gas in order to assist in squeezing the bag to expel the contents thereof as known in the art. These filling procedures place a significant stress on the bag and particularly on the bag at the point where the bag seam joins or is sealed or welded with the valve fitment. An issue with the numerous known bag products on the market is that the stresses, described above, can lead to leakage around the seal or weld of the product bag and the fitment of the valve body.

The creation of this seal or weld between the bag and the valve fitment has been addressed in the past by a diamond or wedge shaped, angled fitment as disclosed in Davies et al. U.S. Pat. No. 5,169,037. This wedge shaped valve connector is defined by four distinct planar sides where each planar side is welded to a respective portion of the inside of the product bag. Additionally, this connector is spaced from the valve body by an elongate axially directed extender. Such an extender can lead to particular problems in aligning the fitment with the appropriate seam or seal section of the bag.

Besides this, the solid wedge shape of such fitments provides a planar surface which often does not seal properly with the edges of the bag because of manufacturing issues, for example overheating of the planar surfaces.

The problem associated with such planar sides and sharp angles of such a connector or fitment is that of heating the flexible product bag material in order to obtain an adequate seal across the whole surface area of each planar side. Providing such heat over the whole planar surface is slow and takes a certain dwell time to sufficiently heat the entire surface. Furthermore, the longer the heating platen or sealing device is in contact with or dwells on the gab and fitment, the more risk there is of overheating. Such overheating can lead to the bag tearing free from the connector and hence leakage occurring at the seal or weld between the product bag and the fitment.

It has been previously known in the art to use horizontally extending ribs to engage with the sides of the bag, for instance in U.S. Pat. No. 5,823,383 to Georg Menshen GmbH & Co. KG, of Germany. However, the particular design of these connectors has generally been for refill type applications for liquid soaps and detergents and has not been intended for higher pressure aerosol dispensing situations.

OBJECTS AND SUMMARY OF THE INVENTION

It is, therefore, an object of the present invention to overcome the above noted issues of the known devices and produce a fitment which facilitates the sealing of the valve fitment to the product dispensing bag.

It is another object of the present invention to provide a unique horizontal rib structure which strengthens the sealing interaction between the product dispensing bag and the valve fitment.

It is a still further object of the present invention to provide a two-way valve in cooperation with such a ribbed fitment which enables the below discussed product to be used in conjunction with a pressurized aerosol filling manufacture.

Another object of the present invention is to form a valve body having a fitment construction which facilitates the molding and fabrication of the fitment itself by known fabrication processes.

A further object of the invention is to provide a fitment on the valve body which permits a substantial increase in the speed of sealing as well as the reliability of the seal between the bag and the fitment itself.

A still further object of the present invention is to provide a vertical flashing at the corners of the fitment which extend continuously from the valve body down into the product dispensing bag to ensure that the product bag is fully engaged with the fitment and ease the sealing transition from the product bag welded or sealed to the fitment to the bag being engaged with itself along the edges of the product bag.

BRIEF DESCRIPTION OF THE DRAWINGS

FIGS. 4A and 4B are an elevational side view and elevational front view respectively of the valve body and fitment in conjunction with the mounting cup;

FIG. 5 is a top plan view of the mounting cup and valve body;

FIG. 6 is a cross-sectional view of the fitment and valve body, including a male valve stem and spring;

DETAILED DESCRIPTION OF THE PREFERRED EMBODIMENTS

Figure 1:
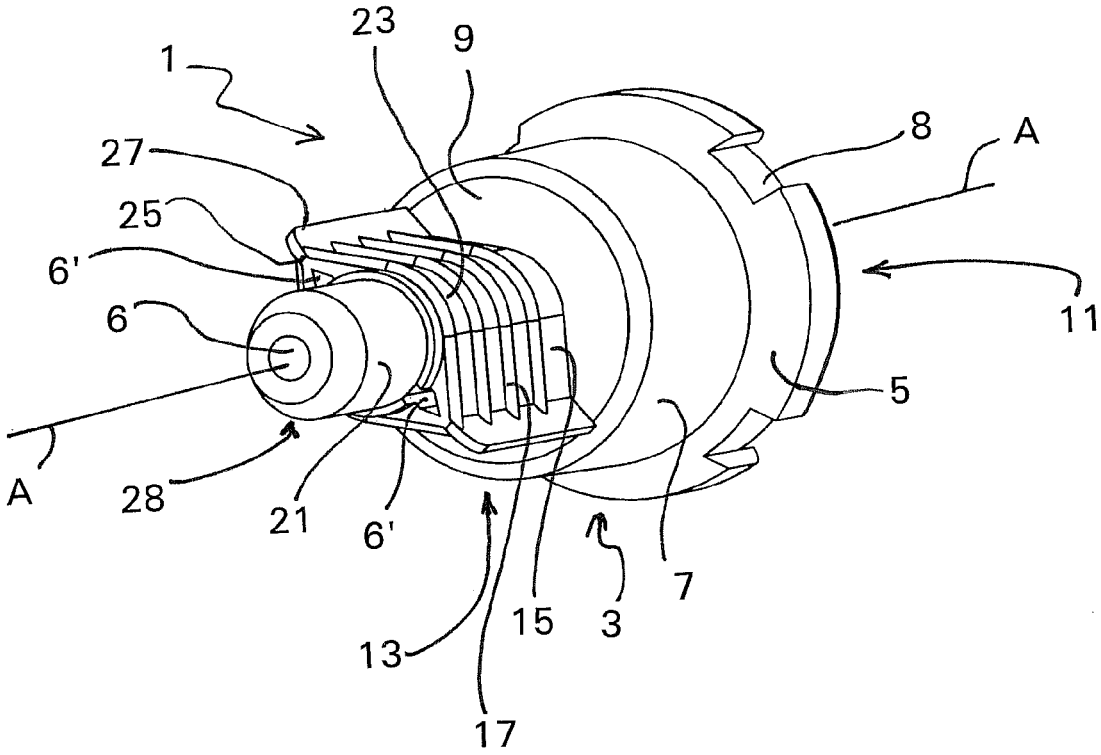
FIG. 1 illustrates a perspective view of a valve body and fitment for connection and sealing with a product bag according to a first embodiment of the present invention.
Figure 2:
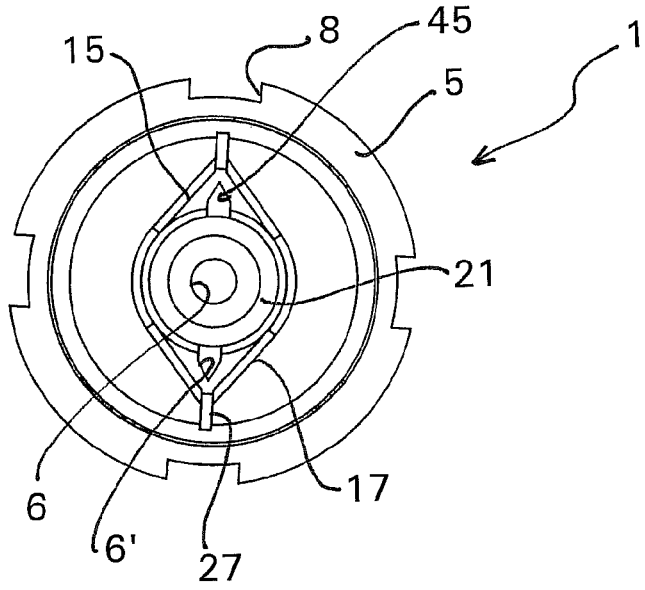
FIG. 2 is a plan bottom view of the valve body and fitment of the present embodiment.

FIGS. 1 and 2 illustrate a perspective and bottom planar view respectively of a valve body and fitment 1 of the present invention. A central product bore 6 is defined through the center of the valve body and fitment 1 along a longitudinal axis A. Adjacent product bores 6' generally parallel with the longitudinal axis A may also be provided through the valve body and fitment 1 to increase the product flow through the valve. The spring cup and and fitment 1 includes a spring cup portion 3 which is comprised of a mounting cup engaging flange 5 integral with a sidewall 7 and a base 9 together defining a cavity 11 in which the valve components may be positioned. The flange 5 also includes keyways 8 for permitting external pressure filling methods to be used for providing pressurized gas to the can once the spring cup and fitment 1 are situated in the mounting cup and attached to a can (not shown). Any number of keyways 8 may be provided including up to 10-12 such keyways 8 through the flange 5.

Attached integral with the base 9 of the body portion 3 is a fitment 13 defined by opposing curved walls 15. Each curved wall 15 is provided with a series of vertically spaced apart curved ribs 17 extending substantially horizontally, i.e., perpendicularly relative to the longitudinal axis A, along the curved walls 15. As will be discussed in further detail below, such ribs 17 facilitate the welding of the flexible bag or pouch to the fitment 13 by focusing the energy necessary to weld a bag or pouch 33 to the fitment at the ribs 17. The lower most free end of the fitment 13 may terminate in a tail piece 28 which is an extension of a fitment stem 21 and extends down into a product dispensing bag or pouch when the flexible bag is sealed or welded to the fitment 13.

The ribs 17 are spaced apart along the curved fitment walls 15 which are curved around the cylindrical fitment stem 21. The walls 15 are radially bent or curved in their center portion 23 so as to conform and pass over the cylindrical fitment stem 21. The walls 15 then extend in a substantially planar manner from the longitudinal axis A to form an extended edge or corner 25 of the wall 15 mating with a corresponding extended edge or corner 25 of the opposing wall 15. At the mating corners 25 of the opposing walls 13, the fitment 13 further includes a vertical flashing 27 integrally connected with the mating curved walls 15 and the ends of the curved ribs 17.

Figure 3:
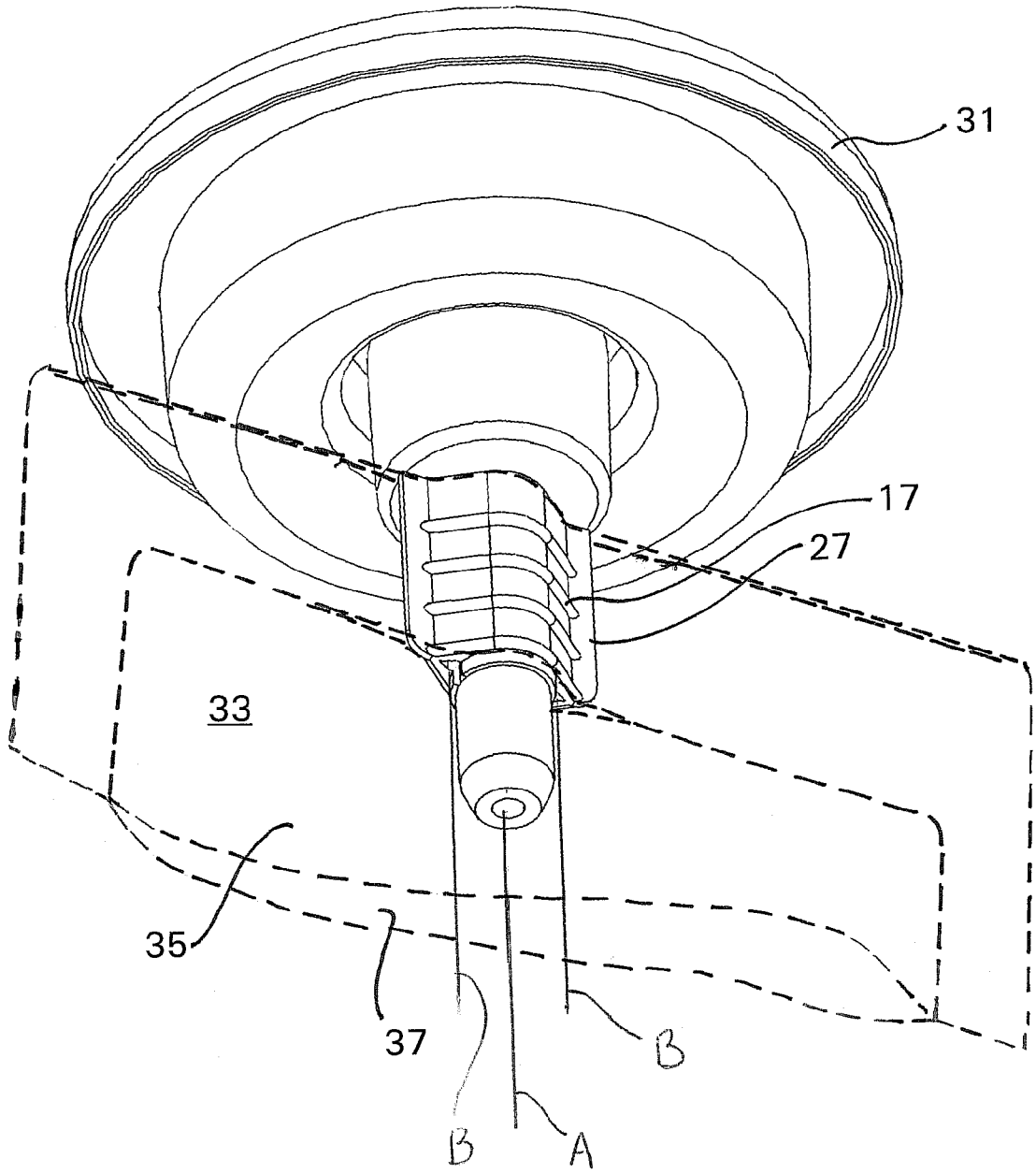
FIG. 3 is a perspective view of the valve body and fitment in conjunction with a mounting cup prior to engagement of the fitment with a product dispensing bag.

Better seen in FIG. 3 where the valve body and fitment 1 is shown in conjunction with a mounting cup 31, the flashing 27 is connected at a top end with the base 9 of the spring cup 3, and depends vertically downward therefrom, along the corners 25 of the fitment 13 parallel with the longitudinal axis A of the spring cup portion 3. The flashing 27 depends downwards approximately the longitudinal length of the fitment 13 and radially outwards from the corners 25 to a desired distance, preferably a distance substantially the same as the radius of the sidewalls 7 of the valve body 1.

The flashing 27 is generally quite thin, in the range of 0.001 to 0.10 of an inch, and more preferably in the range of 0.008 to 0.012 of an inch and may be relatively flexible with regards to the rigid valve body and fitment 1 which are generally formed out of plastic, polyethylene or other such polymer material. The flashing 27 is important in order to help seal the flexible bag or pouch adjacent the extreme corners 25 of the fitment 13. As shown in FIG. 3, the bag or pouch 33 has a front panel 35 and a back panel 37 which are joined at mating side edges to form the enclosed bag or pouch 33. Along the top of the mating side edges a portion of both the front and back panels 35, 37 are welded, attached or adhered to the ribs 17 on the corresponding fitment wall 15 to seal the bag or pouch 33 to the fitment 13. It is to be appreciated that the flashing 27 facilitates filling any void at the specific point where the mating side edges of the product dispensing bag must come together to adhere, i.e., or seal on one another, as opposed to sealing with the fitment walls 15. As is discussed in further detail below, the sealing effect of the flashing 27 is improved by varying the thickness of the flashing 27 from a thinner top portion adjacent the base 9 of the valve body portion 1 to a thicker lower portion adjacent the nipple 28 of the valve body and fitment 1. The flashing 27 thus eases this transition and assists in filling any void where there might not be complete sealing of the edges of the bag or pouch 33.

Turning to FIGS. 4A, 4B, 5 and 6, the valve body portion 1 is intended to house a valve 39, either a one-way or more preferably a two-way valve and related components to facilitate filling and dispensing of a product from the bag or pouch 33. In either case, the valve components generally include: a valve stem 41, a spring 42 and a valve seal 43 which, in various configurations, seals the passage of a pressurized fluid up and out, as in the case of dispensing, the stem 41 when the stem 41 is actuated. Additionally, as a two-way valve, these components also permit the rapid filling of the bag or pouch 33 by an appropriate filling machine via the valve stem 41. These internal components of a two-way valve 39 can be inserted into the valve body portion 1 at any point during the manufacturing process, i.e., either before the sealing or welding of the product dispensing bag to the fitment 13 or afterwards.

In order to facilitate the filling and dispensing of product through the valve and fitment 1, a number of other adjacent product bores 6' besides the central product bore 6 may also be provided through the fitment 13. Such additional bores 6' provide for more volumetric flow into and out of the bag 33 so that products such as gels, for example shaving gels, may be adequately dispensed. The bores 6' may be separated from the main bore 6 but, in general, are integral and communicate directly therewith, i.e., the bores 6' are merely a part or portion of the main bore 6 extending between the cavity 11 of the spring cup 3 and the interior of the bag or pouch 33.

To increase the volume of the flow path, the bores 6' are positioned where the extending walls 15 of the fitment 13 being extending away from the fitment stem 21 and correspondingly reaching towards one another so as to form the corners 25 of the fitment 13. An inlet 43 of the additional bores 6' is located at the base of the narrowing walls 15 on either side of the fitment stem 21. Observing FIGS. 1, 2 and 3, these additional bores 6' are formed, for example, substantially as triangles, although other shapes are possible, having converging sidewalls 45 intersecting at an apex to maximize the volume of flow therethrough. Where the converging sidewalls 45 are generally parallel with and spaced a desired distance from the extending fitment walls 15 so as to inhibit compromising the integrity of the sidewalls 45. As seen in FIG. 6, these additional bores 6' extend from the inlets 43 parallel with and essentially as part of the central product bore 6 and communicate into the interior of the cavity 11 of the spring cup portion 3.

In the case of the spring cup 3 and fitment 1 for an aerosol valve as described herein, the additional bores 6' are important because they provide a larger flow volume through the relatively small fitment 13 into the spring cup 3. In the aerosol and pressurized can and valve industry, it is standardized that the entrance to the can is one (1) inch in diameter. The spring cup 3 and fitment 1 thus must generally be smaller than one (1) inch in diameter to fit through the opening into the can. Also, because a bag or pouch 33 is attached to the fitment 1 and wrapped around the fitment prior to insertion, the pouch 33 must also be wrapped smaller than one (1) inch so as to facilitate entry into the can as well. The largest width of the fitment 13 between the outside edges of the flashing 27 must therefore be smaller than one (1) inch, and as seen in FIG. 2, may be smaller than the outer diameter of the spring cup 3. The problem which arises is to effectively size the main bore 6 through such a size limited fitment 13.

One solution is the additional bores 6' having a longitudinal axis B which is offset from that of the main axis A of the bore 6. Alternatively, because the bore 6 and additional bores 6' are generally integral with one another, such an integrated bore can be described as a non-cylindrical bore with a varying radius about the main axis A. In any event, such a non-cylindrical bore 6, 6' increases the available volume for flow of product into the interior 11 of the spring cup 3.

In addition, as seen in FIG. 6, in order to ensure that where a dip tube D is used the dip tube D does not interfere or reduce the flow volume of the non-cylindrical bore 6, 6', a slight step or boss 47 may be provided at a base of the fitment 13 where the fitment walls 15 transition to the tail piece 28 to ensure that a dip tube D engaged with the tail piece 28 does not block the inlets 43 to the bores 6'. In other words, a dip tube D having a first end and an inner diameter substantially similar to the outer diameter of the tail piece 28 which is slid over the tail piece 28, the first end of the dip tube D will abut against the boss 47 and cannot be further axially engaged along the tail piece 28 and hence blockage of the additional bore 6' is avoided and the dip tube D is thus attached entirely external to the non-cylindrical bore 6, 6' and does not limit the flow of product therethrough.

It is another important aspect of the present invention that the ribs 17 are provided with a gentle bend or curve extending around a portion of the fitment stem 21 so as to more completely engage a product dispensing bag or pouch 33 which is sealed thereto. In other words, without any sharp corners along the length of the curved wall 23, the bag 33 is more likely to adhere and be welded directly to the entire length of the ribs 17 along the walls 15 so as to create a more secure lateral seal and hence a multitude of lateral seals along the longitudinal length of the fitment 13. Where the fitment walls 15 engages the bag or pouch 33, the side edges of the bag 33 are welded directly to the ribs 17 to form a plurality of adjacent seals between the fitment 13 and the bag 33. The ribs 17 focus the energy, e.g., heat, ultrasonic, etc., necessary to attach or weld the bag 33 to the fitment 13 along a portion of the entire curved wall. Thus, the entire curved wall does not need to be heated or welded and this focused energy along only the ribs 17 increases the speed at which the bag or pouch 33 can be attached to the fitment 13. With a plurality of such spaced apart ribs 17 formed in such a manner along the longitudinal axis of the device, an adequate seal is therefore also provided. Depending upon the effect desired, the bag 33 may also be attached to the portions of the fitment wall 15 extending between the spaced apart ribs 17.

Figure 7:
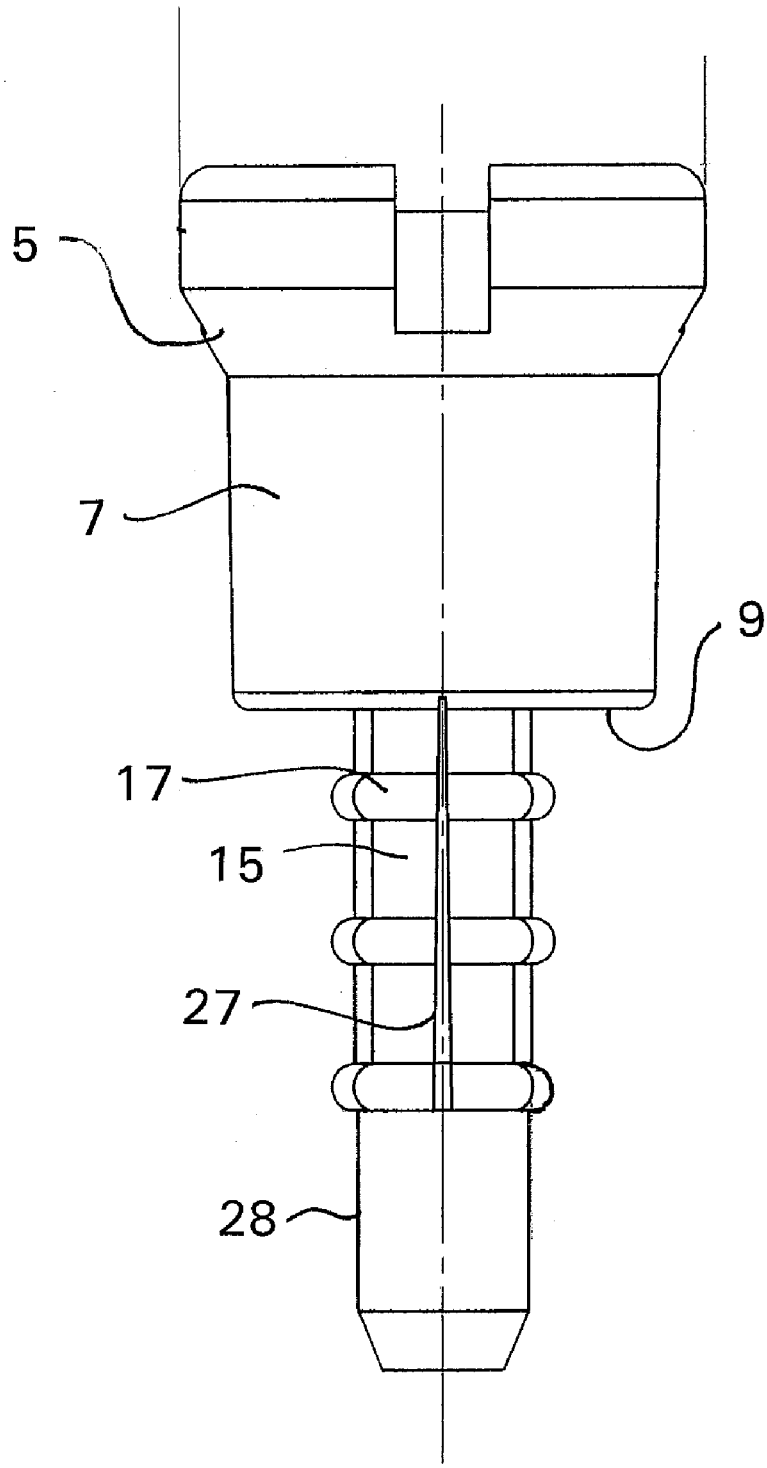
FIG. 7 is a side elevational view of the valve body and fitment illustrating the vertically differentiated thickness of the flashing along the longitudinal axis of the valve body and fitment.
Figure 8:
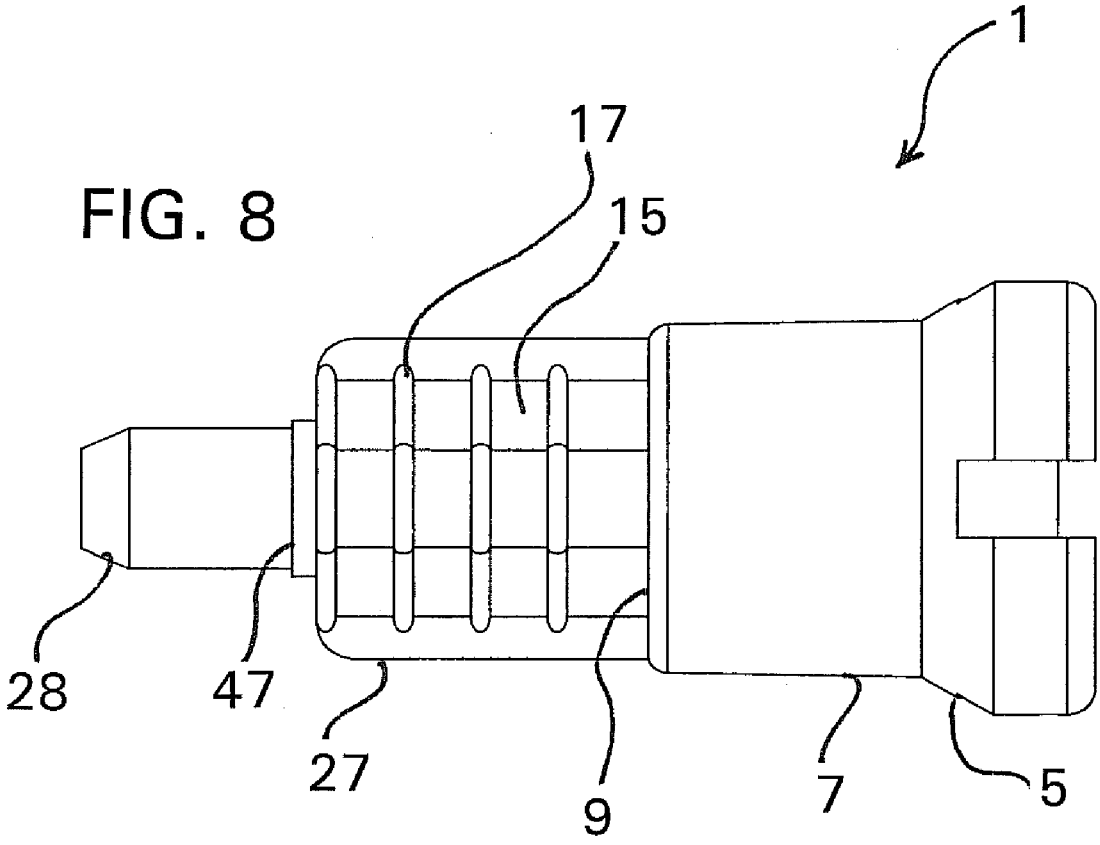
FIGS. 8 and 9 are a respective front and side elevational view of the valve body and fitment of an embodiment of the present invention having a constant thickness flashing.
Figure 9:
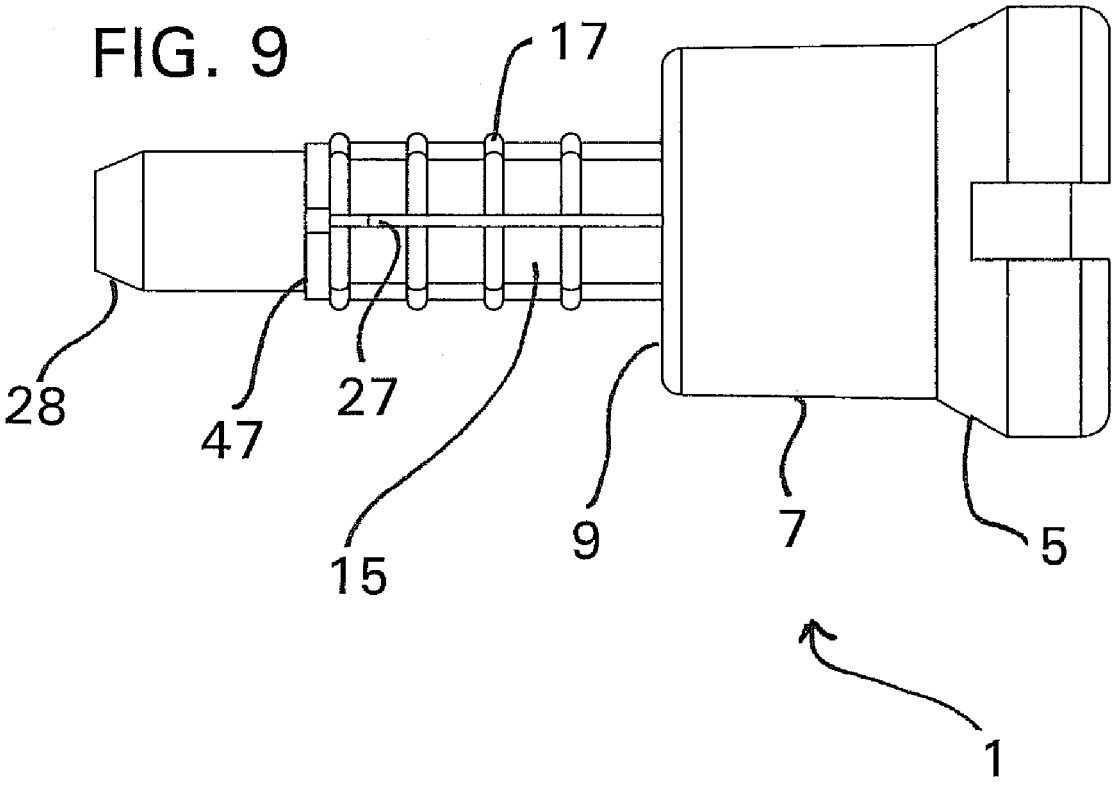

FIG. 7 gives a detailed view of an embodiment of the present invention having a variable thickness of the flashing 27 where the flashing decreases in thickness towards the nipple 28. As can be appreciated, because the product bag 33 is generally in an expanded state with product and a certain pressure being exerted on the seal or weld between the fitment 21 and the product bag 33, a wider bottom portion of the flashing accommodates the fact that the opposing front and back panels 35, 37 of the product bag 33 flare away from one another substantially at this point. Thus, the thicker bottom portion of the flashing 27 permits a slight separation and stress relief between opposing panels and joined side walls of the product bag 33 at the point where the opposing side walls of the bag 33 are attached to the fitment stem 21 and generate a high degree of stress on the sealing or welding of the product bag 33 to the fitment stem 21. For production purposes, the fitment stem 21 may be provided with a reverse variable thickness of the flashing 27 from that shown here so as to facilitate the manufacturing of the fitment stern 21. It is also to be appreciated, as seen in FIGS. 8 and 9 that such flashing 27 may also be of a constant thickness along its longitudinal length.

Figure 11:
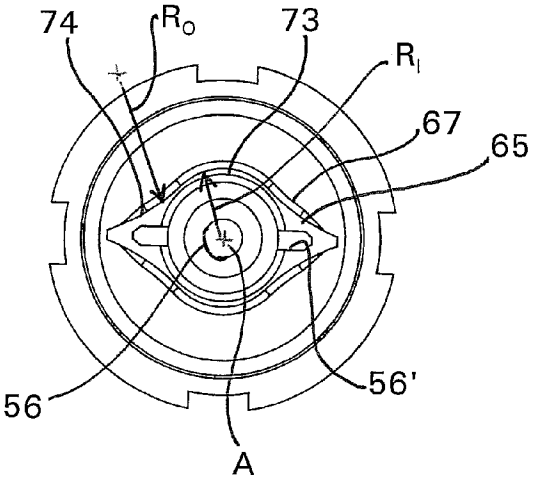
FIG. 11 is a bottom plan view of the valve body and fitment of the second embodiment.
Figure 10:
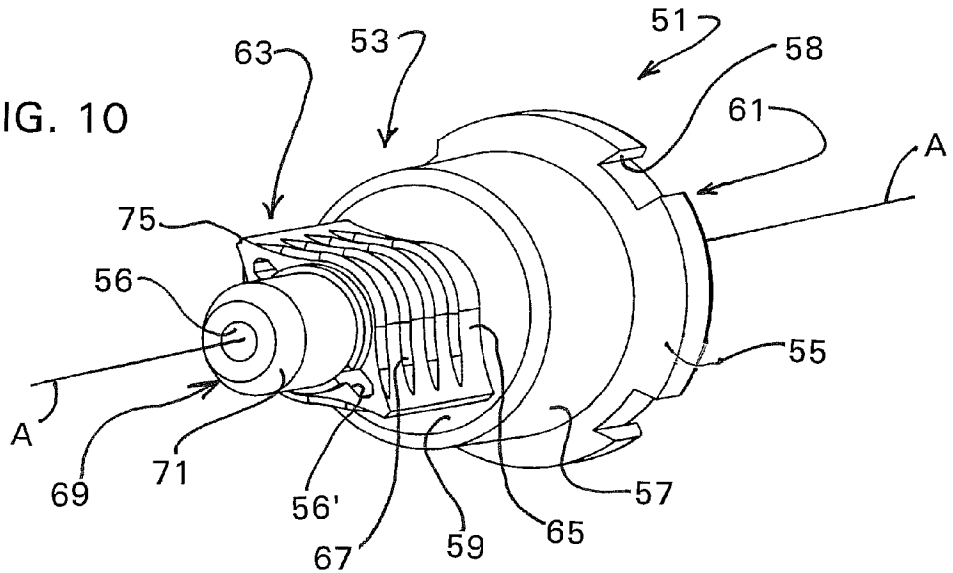
FIG. 10 illustrates a perspective view of a valve body and fitment for connection and sealing with a product bag according to a second embodiment of the present invention.

FIGS. 10-18 disclose yet another embodiment of the present invention where FIGS. 10 and 11 illustrate a perspective and bottom planar view respectively of a second embodiment of a valve body and fitment 51 of the present invention. A central product bore 56 is defined through the center of the spring cup and fitment 51 along the longitudinal axis A. Adjacent product bores 56' generally parallel with the longitudinal axis A may also be provided through the valve body and fitment 51 to increase the product flow through the valve. The valve body and fitment 51 includes a valve body portion 53 which is comprised of a mounting cup engaging flange 55 integral with a sidewall 57 and a base 59 defining a cavity 61 in which the valve components may be positioned. The flange 5 also includes keyways 58 for securing the valve body 53 to a mounting cup 55.

Attached integral with the base 59 of the body portion 53 is a fitment 63 defined by opposing substantially teardrop-shaped curved walls 65. Each curved wall 65 is provided with a series of vertically spaced apart curved ribs 67 extending substantially horizontally, i.e., perpendicularly relative to the longitudinal axis A, along the tear-drop shaped curved walls 65. A tear-drop shaped wall 65 is understood to be a wall with a reversing radius of curvature. In other words, where the center portion 73 of the curved wall 65 is defined by a radius of curvature Ri extending from the longitudinal axis A internal and within the spring cup and fitment 51, this center portion 73 transitions in a reverse curve to an extended portion 74 of the wall 65 which is defined by a radius of curvature Ro externally located with respect to the valve body and fitment 51. As will be discussed in further detail below, such ribs 67 facilitate the welding of the flexible bag or pouch 33 to the fitment 63. The lowermost free end of the fitment 63 may terminate in a tail piece 69 which, of course, extends down into a product dispensing bag or pouch 33 when the bag is sealed or welded to the fitment 63.

The ribs 67 are spaced apart along the curved fitment walls 65 which are substantially teardrop-shaped and formed around the cylindrical fitment stem 71 and the transition to the extended wall portion 74. The walls 65 are radially bent or curved in their center portion 73 so as to conform and pass over the cylindrical fitment stem 21. The fitment walls 65 then transition to the reverse curvature and extend from both sides of their curved center portion 73 at an increasingly radial distance from the longitudinal axis A to form the extended wall portion 74 ending at an edge or corner 75 of the wall 65 mating with the corresponding extended edge or corner 75 of the opposing wall 15. Although not shown here, similar to the first embodiment, at the mating corners 75 of the opposing walls 65, the fitment 51 may further include a vertical flashing integrally connected with the mating curved walls 65 and the ends of the curved ribs 67.

As shown in FIG. 3, the bag or pouch 83 has a front panel 85 and a back panel 87 which are joined at mating side edges to form the enclosed bag or pouch 83. Along the top of the mating side edges, a portion of the front and back panels 85, 87 are welded or adhered to the ribs 67 on the corresponding fitment wall 65 to seal the bag or pouch 83 to the fitment 63. Substantially different from the known wedges and planar sides thereof, the reversing radius of curvature Ro facilitates the smooth transition of the bag or pouch 83 where it is welded or sealed with the ribs 67 to the point at the corners 75 of the fitment 63 to where the side edges of the bag 83 are welded or sealed with one another. Such a transition eliminates any void at the specific point where the mating side edges of the product dispensing bag must come together to adhere, i.e., or seal on one another, as opposed to sealing with the fitment walls 65. It is, of course, also possible to include flashing at the corners 75 of this second embodiment as well, if necessary. The flashing thus may further assist the reverse curvature Ro transition in filling any void where there might not be complete sealing of the edges of the bag or pouch 83.

Turning to FIGS. 13A, 13B, 14 and 15, the valve body portion 53 is intended to house a valve 89, either a one-way or more preferably a two-way valve and related components to facilitate filling and dispensing of a product from the bag or pouch 83. In either case, the valve components generally include: a valve stem 91, a spring 92 and a valve seal 93 which, in various configurations, facilitate the passage of a pressurized fluid up and out, as in the case of dispensing, the valve stem 91 when the valve stem 91 is actuated. Additionally, as a two-way valve, these components also permit the rapid filling of the bag or pouch 83 by an appropriate filling machine via the valve stem 91. These internal components of a two-way valve 89 can be inserted into the valve body portion 53 at any point during the manufacturing process, i.e., either before the sealing or welding of the product dispensing bag to the fitment 63 or afterwards.

In order to facilitate the filling and dispensing of product through the valve body and fitment 51, a number of other adjacent product bores 56' besides the central product bore 56 may also be provided through the fitment 63. Such additional bores 56' provide for more volumetric flow into and out of the bag 83 so that products such as gels, for example shaving gels, may be adequately dispensed. The location of such additional bores 56' is problematic in that there must be sufficient sidewall thickness around the bores 56, 56' so as to ensure that especially during sealing and welding of the bag or pouch 83 to the fitment, that such bores 56, 56' are not compromised.

Figure 12:
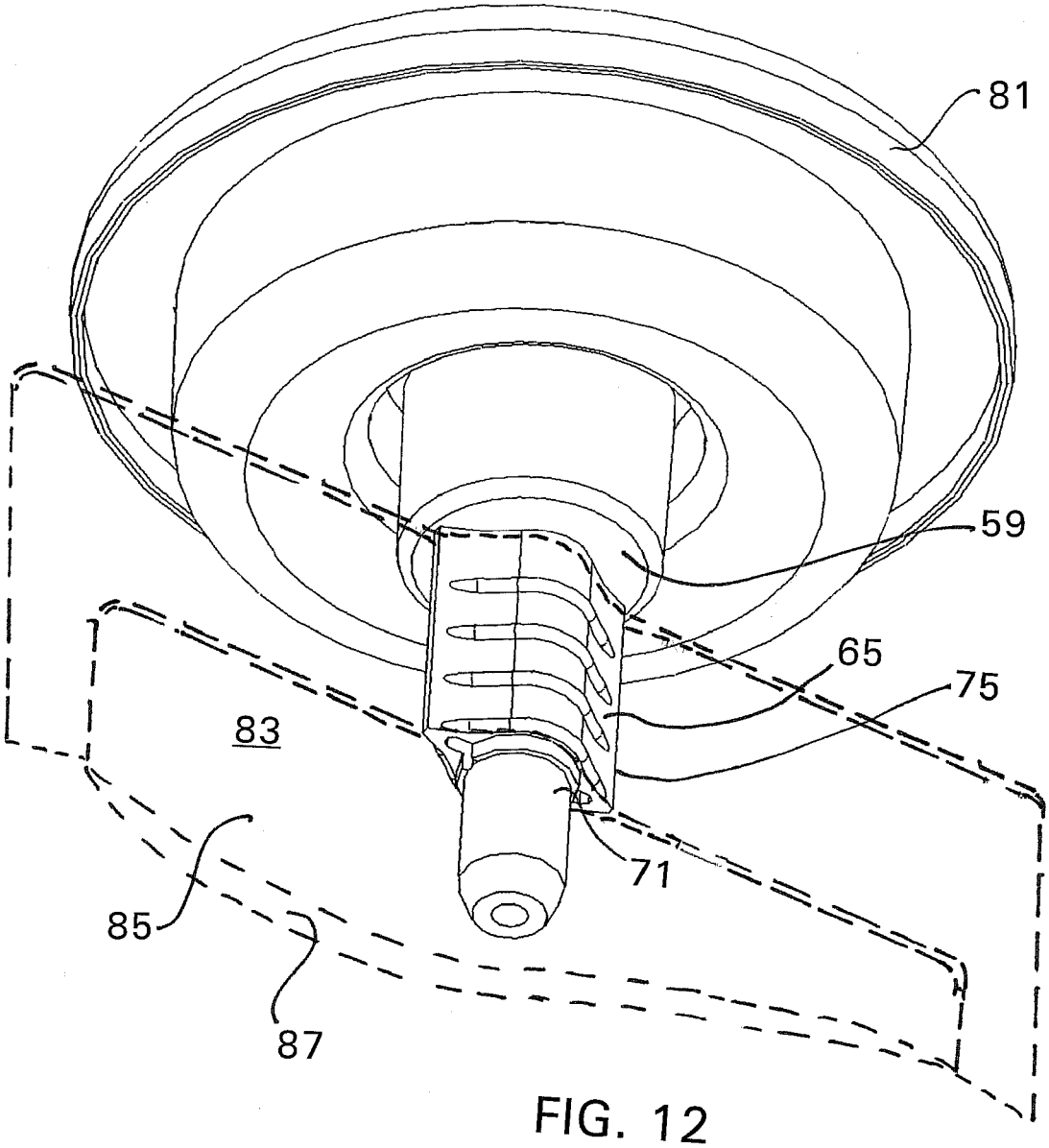
FIG. 12 is a perspective view of the valve body and fitment of the second embodiment in conjunction with a mounting cup prior to engagement of the fitment with a product dispensing bag.
Figure 13A:
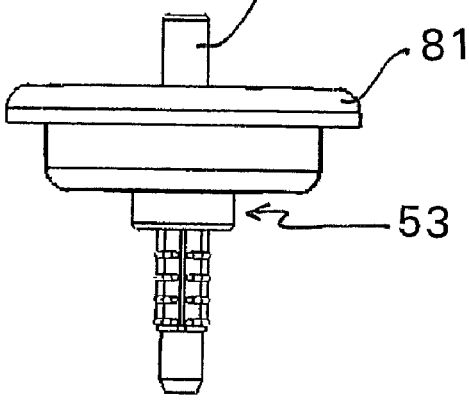
FIGS. 13A and 13B are an elevational side view and elevational front view respectively of the valve body and fitment in conjunction with the mounting cup.
Figure 13B:
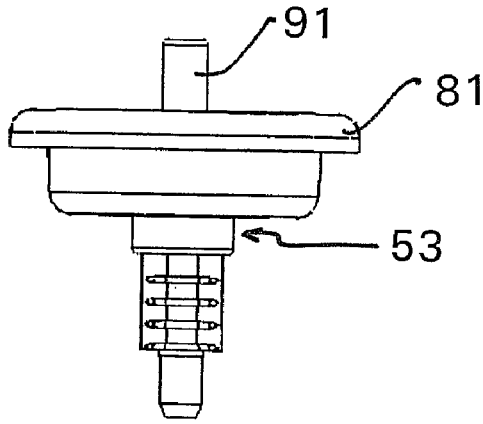
Figure 14:
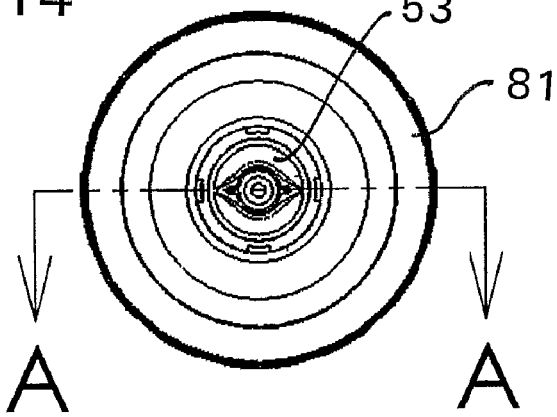
FIG. 14 is a top plan view of the mounting cup and valve body of the second embodiment.
Figure 15:
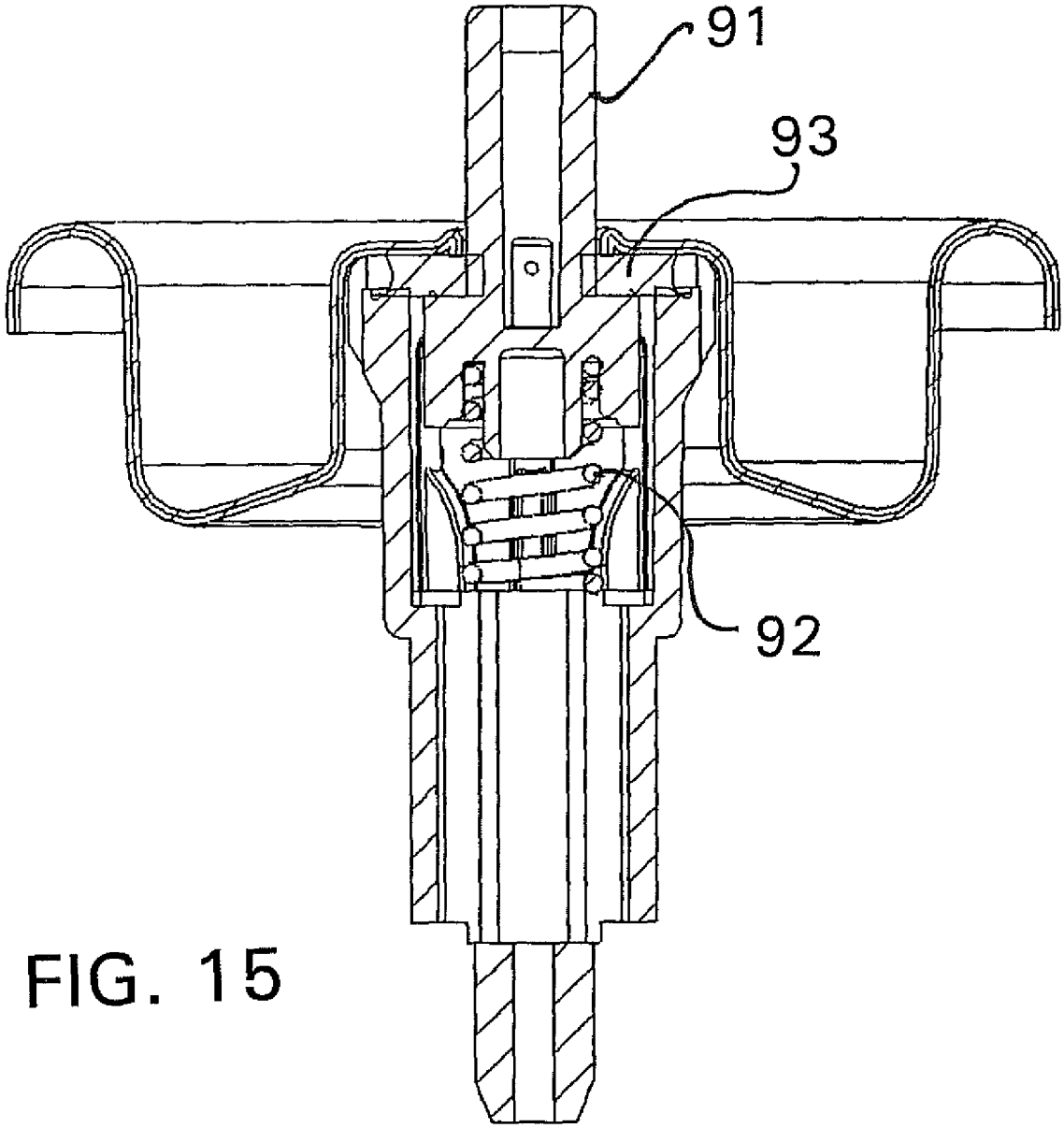
FIG. 15 is a cross-sectional view of the fitment and valve body of the second embodiment, including a male valve stem and spring.

To overcome such issues, where the filament walls 65 of the fitment 63 begin extending away from the fitment stem 71 and correspondingly reaching towards one another so as to form the corners 75 of the fitment 63, an inlet 93 of the additional bores 56' is located at the base of the narrowing walls 65 on either side of the fitment stem 71 as observed FIGS. 10, 11 and 12. As seen in FIG. 15, these additional bore 56' extend from the inlets 93 parallel with and part of the central product bore 56 and communicate into the interior of the cavity 61 of the spring cup portion 53. The additional bore 56', also known as restricted openings, their arrangement and communication with the main product bore 56 as well as the location in the apex formed by the converging sidewalls 65 are a critical part of the present invention as they allow less viscous materials a sufficient volumetric flow path to be readily used and dispensed from aerosol valves and bag-on-valve products without compromising the integrity of the fitment.

In addition, at a base of the fitment 63 where the fitment walls 65 transition to the tail piece 69, a slight step or boss 97 may be provided to ensure that the dip tube D engage with the nipple 78 does not block the inlets 93 to the passages 56'. In other words, the dip tube D, having a first end and an inner diameter substantially similar to the outer diameter of the nipple 78, which is slide over the tail piece 69, the first end of the dip tube D will abut against the boss 97 and cannot be further axially engaged along the tail piece 69 and hence blockage of the additional bore 56' is avoided.

It is an important aspect of the present invention that the ribs 67 are provided with a gentle bend or curve extending around a portion of the fitment stem 71 so as to more completely engage a product dispensing bag or pouch 83 which is sealed thereto. In other words, without any sharp corners along the length of the curved wall 65, the bag 83 is more likely to adhere and be welded directly to the entire length of the ribs 67 along the walls 65 so as to create a more secure lateral seal and hence a multitude of lateral seals along the longitudinal length of the fitment 63. Where the fitment walls 65 engages the bag or pouch 83, the side edges of the bag 83 are welded directly to the ribs 67 to form a plurality of adjacent seals between the fitment and the bag. Depending upon the effect desired, the bag 83 may also be attached to the portions of the fitment wall 65 extending between the spaced apart ribs 67.

Another important aspect of the present invention is that the ribs 67 taper to an endpoint prior to the edges or corners 75 of the fitment walls 65. This permits the edges of the bag 83 to engage and be welded against the portion of the fitment walls 65 along the entire length of the corners 75 so that a complete and effective seal is maintained as the edges of the front and back panels 85, 87 of the bag 83 traverse from their attachment with the fitment walls 65 to their attachment with one another.

Figure 16:
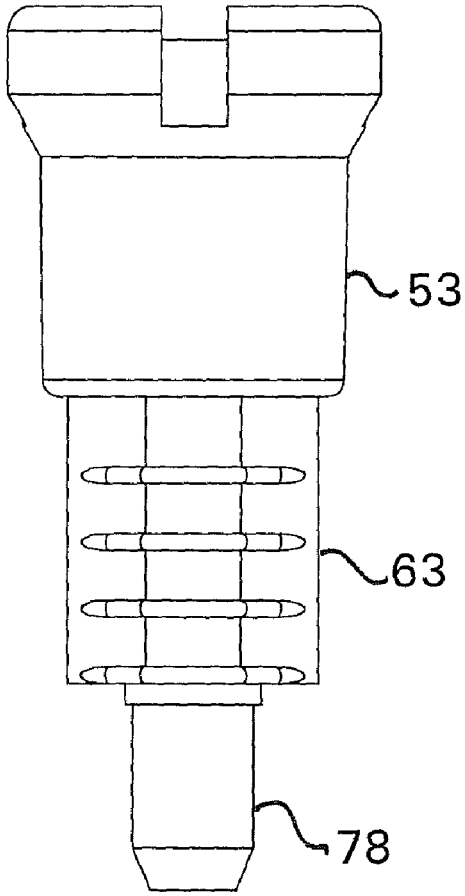
FIGS. 16 and 17 are a respective front and side elevational views of the valve body and fitment of the second embodiment of the present invention.
Figure 17:
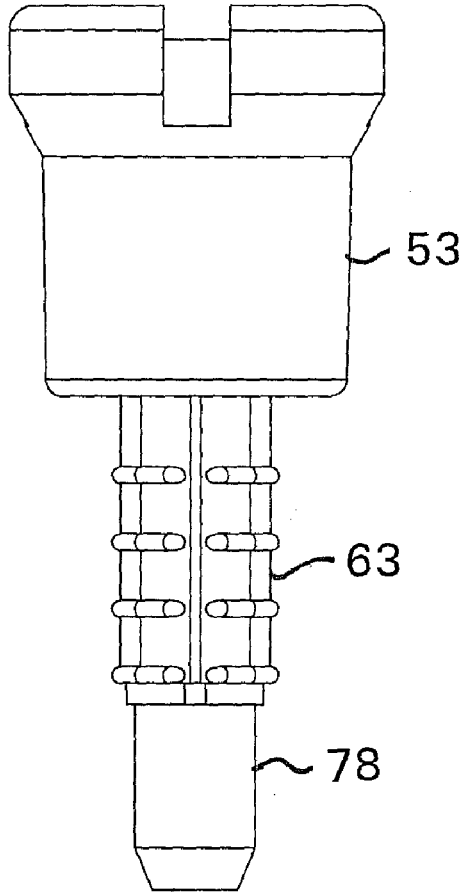
Figure 18:
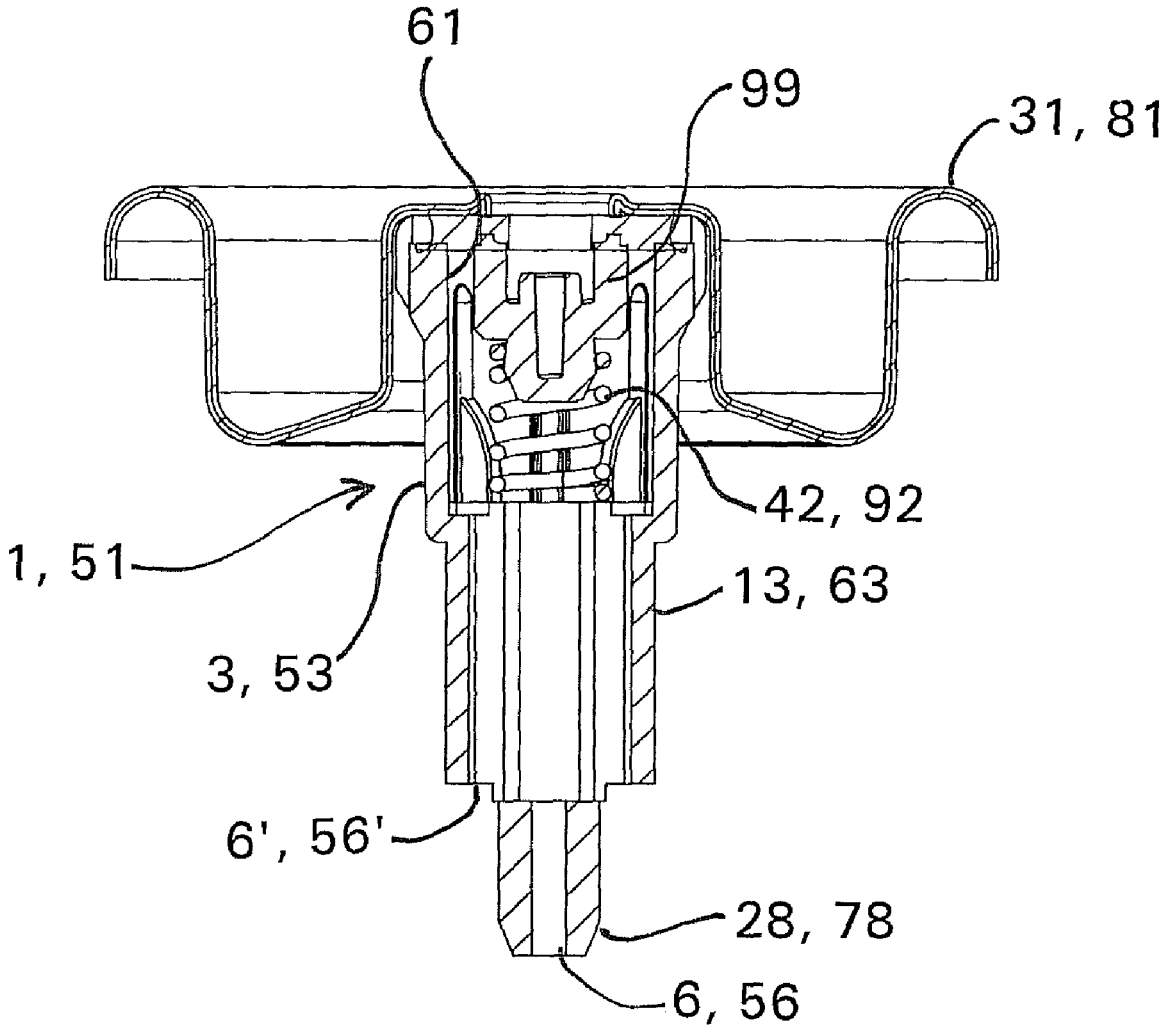
FIG. 18 is a cross-sectional view of the fitment and valve body of the second embodiment, including a female valve stem and spring.
Figure 20:
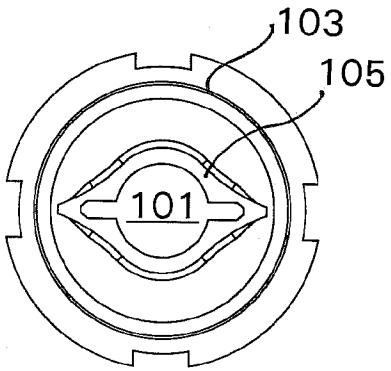
FIG. 20 is a bottom plan view of the valve body and fitment of the second embodiment.
Figure 19:
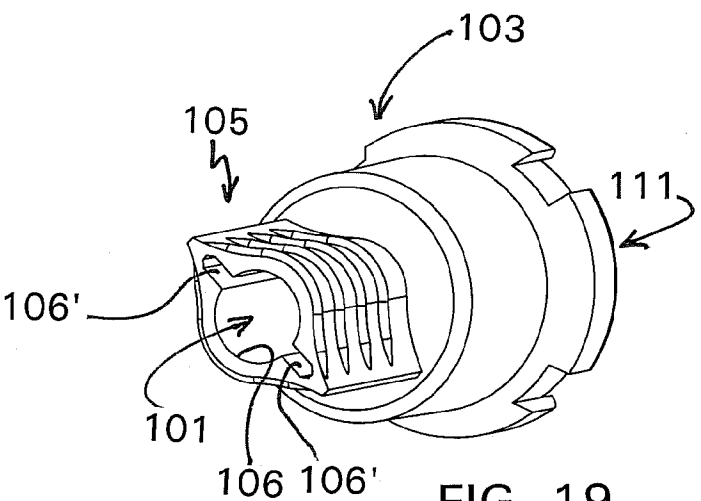
FIG. 19 illustrates a perspective view of the valve body and fitment for connection and sealing with a product bag according to a third embodiment of the present invention.
Figure 21:
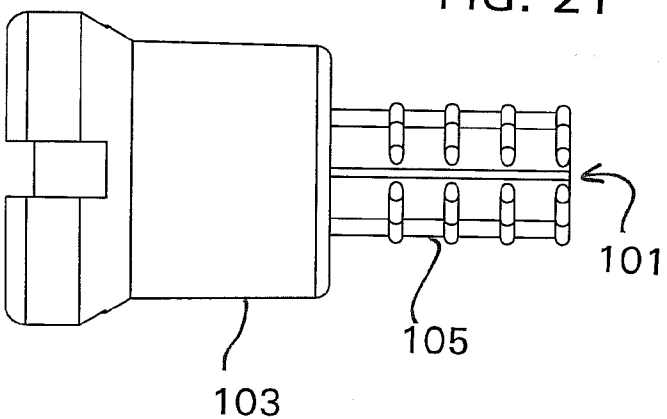
FIGS. 21 and 22 are an elevational side view and elevational front view respectively of the valve body and fitment in conjunction with the mounting cup.
Figure 22:
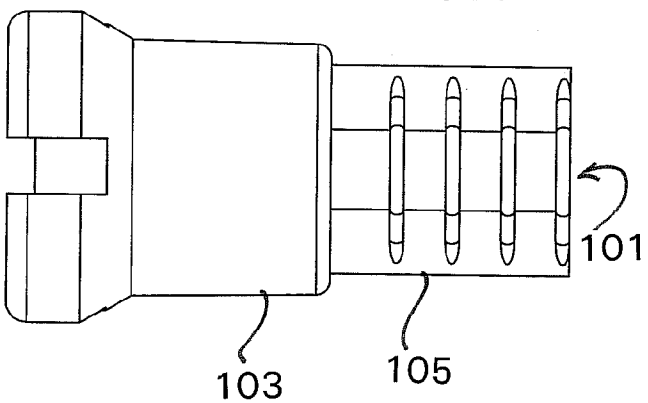
Figure 24:
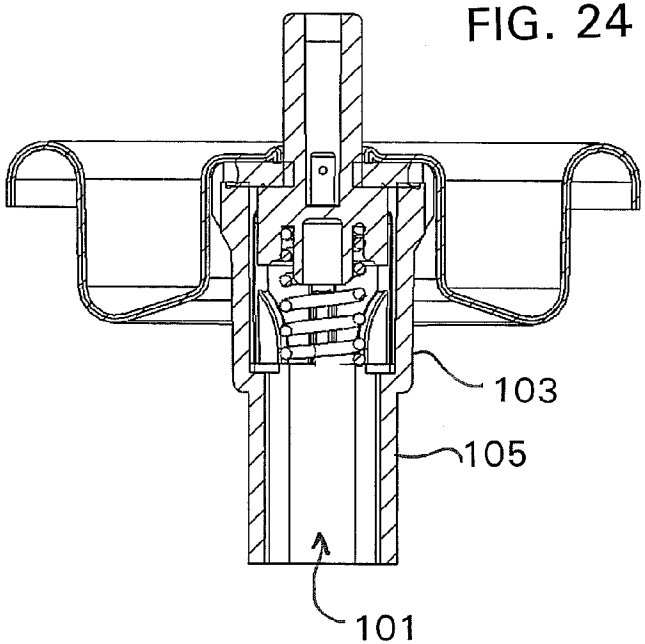
FIG. 24 is a cross-sectional view of the fitment and valve body of the third embodiment, including a male valve stem and spring.
Figure 23:
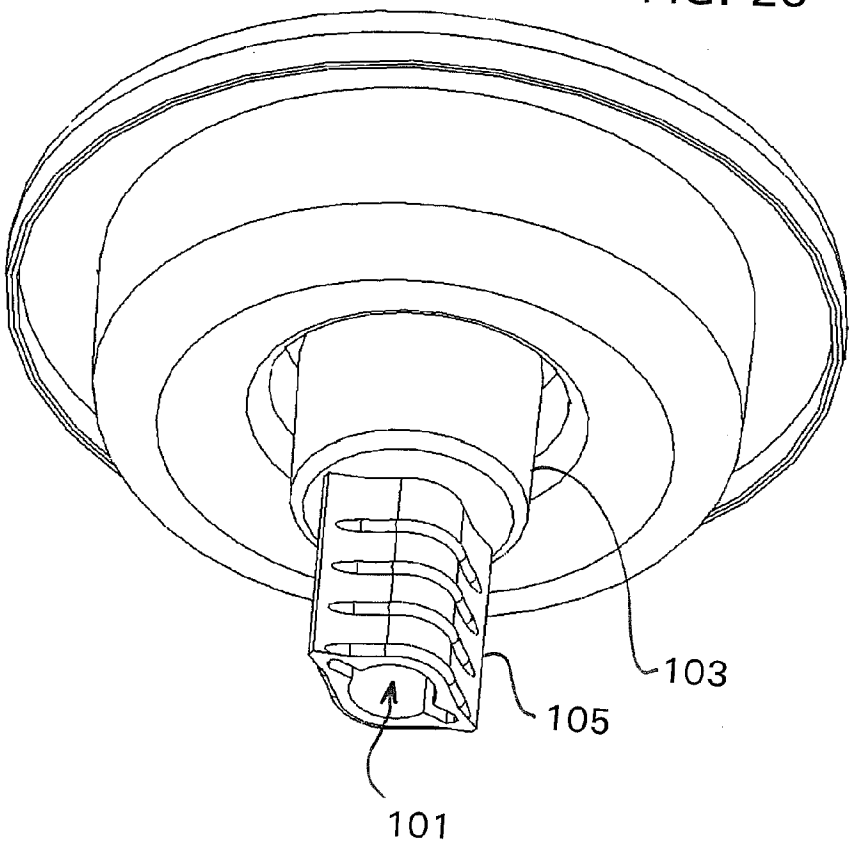
FIG. 23 is a perspective view of the valve body and fitment of the third embodiment in conjunction with a mounting cup prior to engagement of the fitment with a product dispensing bag.

FIGS. 16 and 17 disclose front and side elevational views of the spring cup and fitment 51. FIG. 18 details a still further embodiment of the present invention wherein a female style valve is utilized in conjunction with a fitment of either the first or second embodiment. A female style receiver 99 is located inside the cavity 11 of the valve body portion 3, 53 as well as the spring 42, 92 and the valve seal 43, 93. In all other respects, the valve body and fitment 1, 51 is similar to that of either of the first two embodiment discussed above.

FIGS. 19-24 disclose a still further embodiment of the present invention without the tail piece 28, 69 shown in the first two embodiments. This embodiment discloses an unimpeded or unrestricted product flow passage opening 101 defined by a main flow passage 106 and an integral auxiliary flow bores 106' extending from the bottom of the fitting 105 into the cavity 111 of the spring cup 103. The tail piece 28, 69 is not necessary in a configuration without a dip tube D, thus the tail piece here is eliminated and the product flow passage opening 101 is not restricted by material necessary to form the tail piece.

Figure 27:
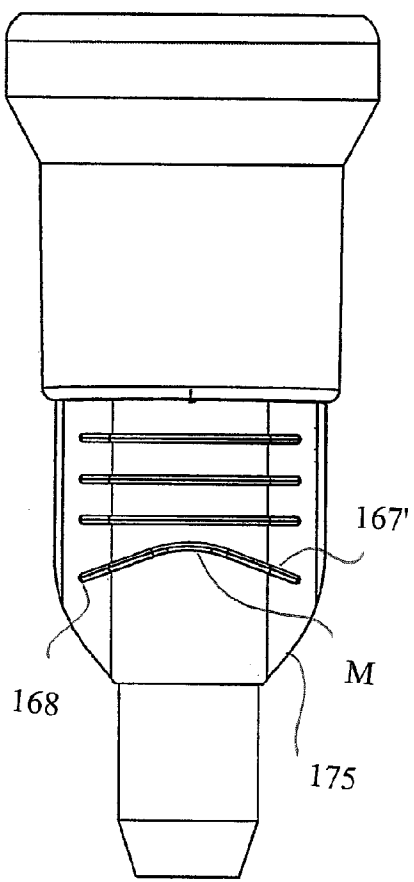
FIGS. 25-27 are elevational views of the valve body and fitment including curved ribs to facilitate a stronger bag to fitment mounting.
Figure 26:
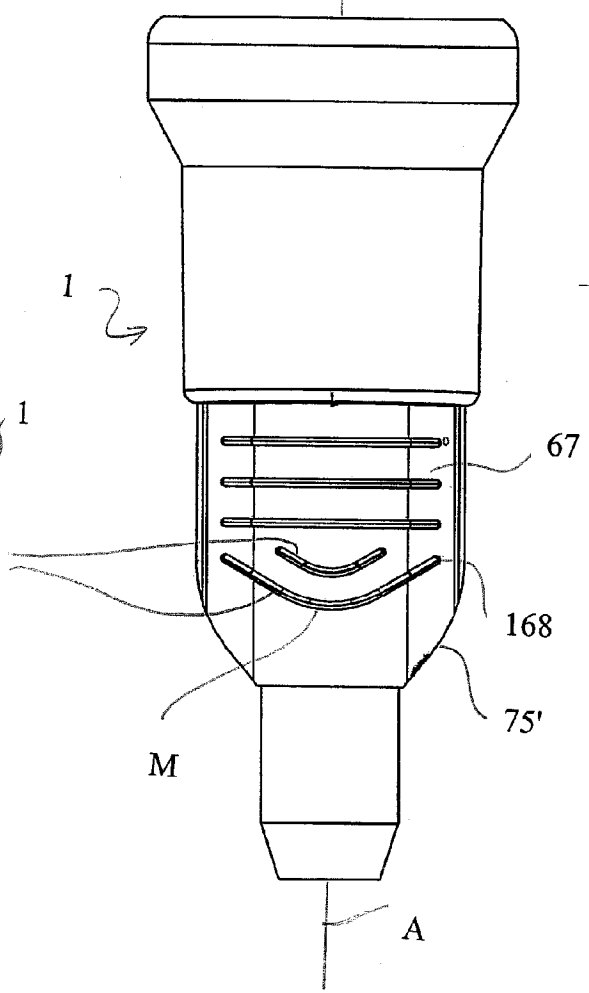
Figure 25:
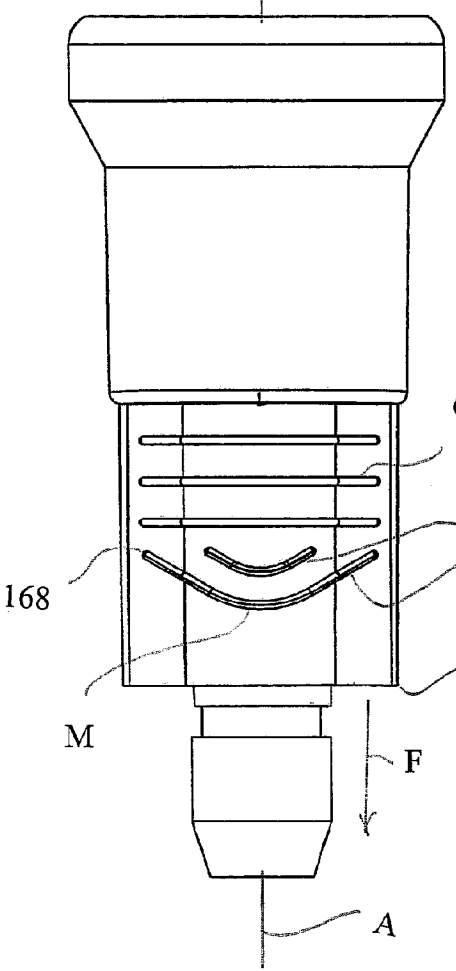

FIGS. 25-27 are a still further embodiment of the present invention where the curved ribs 17, 67 are not all horizontally aligned relative to the fitment, i.e., perpendicular to the longitudinal axis A of the valve as seen in these side elevation plan views. In these elevation views of the fitment 1, certain of the ribs 67 are horizontally straight in the viewing plane and other ribs 167 are curved relative to the longitudinal main axis A of the fitment.

One of the issues which can occur with bag-on-valve type fittings is that a stress point can develop at the lower corners 75 of the fitment where the bag or pouch 33 is sealed to the fitment, As can be appreciated, and referring for the moment back to FIGS. 3 and 12, when the bag 33 is filled with product and pressure, the pressure inside the bag or pouch 33 pushes outwards on the two sides 35, 37 of the bag 33 and can separate the sides 35, 37 from one another if the seal is not sufficient to withstand the internal pressure. Furthermore, the mass of the product contained within the bag also forces the sides 35, 37 apart and even pulls downwards, due to gravity, creating further stress at the sealing between the lower corners 75 and the bag 33.

Where heat is used to secure or weld the bag to the fitment and to the ribs 67 as discussed above, an adequate seal may be formed, however the heat may cause some weakening of the material from which the bag or pouch 33 is fabricated. The pressure and product may exert enough force, especially in the case of an impact, such as the entire product container being dropped on the floor, so that the bag 33 fails at or around this lower corner 75. A rib, for instance as seen in FIGS. 10-12, which ends adjacent or near this corner 75, may exacerbate the situation due to a weakened area of the bag 33 so that this lower corner 75 and any heat sealed portion of the bag 33 adjacent the corner 75 fails upon such stress.

FIG. 25 includes a fitment having the bottom two ribs 167 being curved relative to the horizontal ribs 67 and substantially parallel curved with one another adjacent a bottom edge of the fitment 1. The ribs 167 curve upwardly from a lower midpoint so that ends of the ribs 168 are substantially spaced from the corner 75 of the fitment 1. These curved ribs 167 are important with regards to lessening stress points on the bag 33 which is welded to the fitment because they present a non-horizontal seal along the bag 33 relative to any downward, axial forces F created by a heavy product in the bag 33. In other words, the angled nature of the rib 167, between the lower midpoint M and the end of the rib 168, is now not merely a horizontal component as with the horizontal aligned rib 67 relative to the force F and/or the main axis A, but also has a vertical component, just like a curve in any x-y plane. Having both a vertical and horizontal component to this portion of the seal along the curved bottom ribs 167 may lessen the stress on any one point on the bag 33 and significantly increase the reliability of the bag-on-valve seal.

Similarly, turning to FIG. 26, the lowermost ribs 167 present a horizontal and vertical component which may assist in lowering any single stress point on the bag-on-valve seal. In addition, the corners 75 are chamfered and/or also given a particular curve to eliminate any single stress point. Just like the ribs include a horizontal and vertical component, now the corner 75', which have been chamfered and/or curved now also include both a vertical and horizontal component in an x-y plane which may also reduce any single stress point on the sealing of the bag 33 to the fitment.

Finally observing FIG. 27, the ribs 167' may curve in the opposite direction with the midpoint of the curve being higher and the ends of the ribs 168 depending downwards relative to the view as shown in this elevation plane. Although the ends of the ribs 168 in this embodiment are more directly adjacent the chamfered corners 175, again because of the nature of the horizontal and vertical component of any heat seal or weld which would occur along the rib 167' any single stress point along any part of the curved rib 167' would be significantly reduced.

Since certain changes may be made in the above described and improved valve body and fitment 1, 51 without departing from the spirit and scope of the invention herein involved, it is intended that all of the subject matter of the above description or shown in the accompanying drawings shall be interpreted merely as examples illustrating the inventive concept herein and shall not be construed as limiting the invention.

We claim:

1. A valve body for a two-way valve for use in an aerosol bag-on-valve application, the valve body comprising:

a valve housing having a flange for engagement with a mounting cup for an aerosol can and a cavity defined within the valve housing for receiving valve components of the two way valve;

a fitment integrally connected with the valve housing for attaching to a bag for receiving and dispensing a desired product through the two-way valve, the fitment comprising;

a fitment stem depending from a bottom surface of the valve housing along a longitudinal axis;

a main product passageway formed concentric with the longitudinal axis through the fitment stem to communicate with the cavity of the valve housing;

at least a second product passageway formed parallel with the main product passageway and spaced equidistant from the opposing fitment walls extending to matingly form the corresponding edge; and a pair of oppositely curved fitment walls extending about the fitment stem, each fitment wall having a center portion generally corresponding to the radius of curvature of the fitment stem, the center portion leading to a first and second end portions connected with a corresponding first and second end portions of the adjacent curved fitment wall, the connected first and second end portions defining a pair of opposing edges spaced from the fitment stem.

2. The valve body for a two-way valve for use in an aerosol bag-on-valve application as set forth in claim 1, the valve body further comprising a relatively flexible flashing secured to each of the opposing edges defined by the connection of the respective first and second end portions of the adjacent curved fitment walls.

3. The valve body for a two-way valve for use in an aerosol bag-on-valve application as set forth in claim 1 wherein each of the fitment walls is formed with a plurality of parallel adjacent ribs, each rib extending along the fitment wall transverse to the longitudinal axis of the fitment.

4. The valve body for a two-way valve for use in an aerosol bag-on-valve application as set forth in claim 1, wherein the fitment further comprises a third product passageway opposite from the second product passageway about the longitudinal axis, and also formed parallel with the main product passageway and spaced equidistant from the opposing fitment walls extending to matingly form the corresponding edge.

5. The valve body for a two-way valve for use in an aerosol bag-on-valve application as set forth in claim 1, wherein each of the fitment walls comprises the center portion generally corresponding to the radius of curvature of the fitment stem and an extending portion of the fitment wall leading to the edge having an opposite radius of curvature about a second longitudinal axis defined external of the fitment.

6. The valve body for a two-way valve for use in an aerosol bag-on-valve application as set forth in claim 4 wherein a raised boss is provided between a bottom surface of the fitment walls and a nipple portion of the fitment stem to provide ax axial stop for a dip tube engaged by the nipple portion of the nipple whereby the dip tube is stopped from directly contacting the bottom surface of the fitment walls.

7. A valve body for use in an aerosol bag-on-valve application, the valve body comprising:

a valve housing defining a cavity for receiving valve components;

a fitment integrally connected with the valve housing, the fitment comprising;

a fitment stem depending from a bottom surface of the valve housing along a longitudinal axis;

a main product passageway formed concentric with the longitudinal axis through the fitment stem to communicate with the cavity of the valve housing;

at least a second product passageway formed parallel with the main product passageway and spaced equidistant from the opposing fitment walls; and wherein a pair of adjacent and oppositely curved fitment walls extend about the fitment stem, each fitment wall having a curved center portion leading to a first and second end portions connected with a corresponding first and second end portions of the adjacent curved fitment wall, the connected first and second end portions of the fitment walls defining a pair of opposing edges spaced from the fitment stem.

8. The valve body for a two-way valve for use in an aerosol bag-on-valve application as set forth in claim 7, wherein each of the fitment walls comprises the center portion having a first radius of curvature adjacent the fitment stem and a second radius of curvature extending from the center portion and leading to the edge of the fitment.

9. The valve body for a two-way valve for use in an aerosol bag-on-valve application as set forth in claim 8 wherein the second radius of curvature is reverse from the first radius of curvature.

10. The valve body for a two-way valve for use in an aerosol bag-on-valve application as set forth in claim 7, wherein the fitment further comprises a third product passageway opposite from the second product passageway about the longitudinal axis, and also formed parallel with the main product passageway and spaced equidistant from the opposing fitment walls extending to matingly form the corresponding edge.

* * * * *